US005904237A

United States Patent [19]

Sander et al.

[11] Patent Number: 5,904,237

[45] Date of Patent: May 18, 1999

[54] DEVICE FOR CONVEYING PRODUCTS SUCH AS STACKS OF PRINTED SHEETS

[75] Inventors: Friedrich Sander, Rahden; Gerhard Grannemann, Petershagen; Winfried Hedrich, Rahden, all of Germany

[73] Assignee: Kolbus GmbH & Co. KG, Rahden, Germany

[21] Appl. No.: 08/974,790

[22] Filed: Nov. 20, 1997

[30] Foreign Application Priority Data

Nov. 21, 1996 [DE] Germany ..... 196 48 173

[51] Int. Cl.[6] ..... B65G 43/00; B65G 15/12

[52] U.S. Cl. ..... 198/502.2; 178/626.3; 178/626.4; 178/626.5; 178/626.6

[58] Field of Search ..... 198/502.2, 367, 198/370.8, 370.1, 626.6, 626.2, 626.4, 626.5, 626.3; 271/199, 263, 625.04, 274

[56] References Cited

U.S. PATENT DOCUMENTS

| | | | |
|---|---|---|---|
| 3,170,564 | 2/1965 | Gatto | 198/626.5 |
| 3,468,409 | 9/1969 | Ball | 198/626.6 |
| 3,521,322 | 7/1970 | Michael et al. | 198/626.6 |
| 3,923,145 | 12/1975 | Muller | 198/502.2 |
| 4,518,161 | 5/1985 | Nakamura | 198/367 |
| 5,199,550 | 4/1993 | Wachi et al. | 198/626.5 |
| 5,213,193 | 5/1993 | Mullins | 198/626.5 |
| 5,244,196 | 9/1993 | Walter et al. | 198/626.5 |
| 5,265,713 | 11/1993 | Marchadour | 198/626.4 |
| 5,267,826 | 12/1993 | Peters . | |
| 5,458,051 | 10/1995 | Alden et al. | 198/626.5 |
| 5,531,434 | 7/1996 | Kerschner | 271/263 |
| 5,749,456 | 5/1998 | Logie | 198/626.5 |
| 5,823,316 | 10/1998 | Shaw et al. | 364/502.2 |

FOREIGN PATENT DOCUMENTS

| | | | |
|---|---|---|---|
| 0128 352 | 12/1984 | European Pat. Off. . | |
| 1233058 | 10/1960 | France | 198/626.6 |
| 508541 | 9/1930 | Germany . | |
| 1 184 698 | 12/1964 | Germany . | |
| 1237951 | 3/1967 | Germany | 198/626.6 |
| 70 09 194 | 9/1970 | Germany . | |
| 73 37 175 | 1/1974 | Germany . | |
| 27 24 980 | 11/1978 | Germany . | |
| 28 22 827 | 11/1978 | Germany . | |

*Primary Examiner*—William E. Terrell
*Assistant Examiner*—Wonki Park
*Attorney, Agent, or Firm*—Alix, Yale & Ristas, LLP

[57] ABSTRACT

A device for conveying product stacks of widely differing thicknesses includes counteracting belt conveyors which are each defined by supported operating strands. At least one of the belt conveyors is adjustable relative to the other such that the stack receiving space therebetween is adjustable as a function of the thickness of the stacks to be transported. The spacing adjustment permits variation of the gap in which the stacks are clamped at either of the receiving or discharge end regions of the apparatus. In a preferred device, the upper belt conveyor includes a swivel frame from which a plurality of resiliently biased pressure rollers are supported. Actuators, responsive to sensed stack thickness, produce tilting of the swivel frame about an axis which is itself movable in a plane oriented transverse to the direction of stack movement.

17 Claims, 2 Drawing Sheets

DEVICE FOR CONVEYING PRODUCTS SUCH AS STACKS OF PRINTED SHEETS

BACKGROUND OF THE INVENTION

1. Field of the Invention

The present invention relates to the transport of stacks of printed sheets and, particularly, to the conveyance of collated printed matter which may vary significantly in stack thickness. More specifically, this invention is directed to conveyor systems for loosely stacked products which are received with defined cyclical intervals and which may experience large differences in stack thickness and, especially, to such conveyor systems wherein the direction of motion of the received products may be altered to divert defective products from a main stream. Accordingly, the general object of the present invention are to provide novel and improved methods and apparatus of such character.

2. Description of the Prior Art

While not limited thereto in its utility, the present invention is particularly well suited for use in the movement of loosely stacked products such as, for example, collated sheets of printed material. Belt conveyor systems for moving loosely stacked products between work stations, for example in palletizing installations, are known in the art. Such prior art systems typically have a linearly extending continuous belt conveyor, in the form of an ascending band, and a cooperating continuous belt which functions as a top or clamping band. Such systems may also include a plurality of spring-mounted pressure rollers which act on one of the belts.

Belt conveyor systems of the type generally and briefly described above have also been used for separating incorrectly gathered stacks of printed sheets from a transport channel which leads between a collating machine and a downstream processing machine. Such separating conveyor systems include cooperating bottom and top belt conveyors which extend obliquely with respect to the transport channel and, in response to a command signal provided by a monitoring device, may be caused to intercept and take over the transport of defective stacks. The operation of such prior art separating devices is based upon, and permitted by, the fact that the stacks of printed sheets are fed from the gathering machine at cyclical intervals. Accordingly, a defective stack may be intercepted, clamped between the bottom and top belt conveyors of the separating system and delivered to a discharge conveyor.

In the prior art, the operationally reliable conveying of products such as stacks of printed sheets has been possible only when the deviations in stack thickness fall within a relatively narrow range and when there is at least a predetermined degree of friction between the individual sheets comprising the stacks. A lack of sufficient friction between the sheets will, particularly in the case of a fault which causes an increase in stack thickness, lead to shifting of the sheets relative to one another with resultant stack misalignment or collapse. If the deviations in stack thickness are too large, a stack will either not be clamped between the top and bottom belts of the separating conveyor system or the top and bottom belts of the conveyor system will be too closely spaced to accept the in-coming stack. Any loss of alignment within a stack or failure to receive and engage a stack by the conveyor system will result in production line stoppage with all of the undesirable consequences incident thereto.

SUMMARY OF THE INVENTION

The present invention overcomes the above-briefly discussed and other deficiencies and other disadvantages of the prior art by insuring the operationally reliable conveying of stacks of printed sheets regardless of variations in stack thickness and regardless of the surface characteristics of the individual sheets. Thus, the present invention enables stacks of printed sheets, which are fed successively at cyclical intervals, to be reliably conveyed even when such stacks are of widely differing thicknesses and even when the individual sheets comprising the stacks have a smooth surface finish, i.e., there is very low friction between abutting sheets.

Apparatus in accordance with the present invention comprises counteracting belt conveyors which are each defined by supported operating strands. At least one of the belt conveyors is adjustable relative to the other such that the stack receiving space therebetween is adjustable as a function of the thickness of the stacks to be transported. The spacing adjustment permits variation of the gap in which the stacks are clamped at either of the receiving or discharge end regions of the apparatus. In a preferred embodiment, the upper belt conveyor includes a swivel frame from which a plurality of resiliently biased pressure rollers are supported. Actuators, responsive to sensed stack thickness, produce tilting of the swivel frame about an axis which is itself moveable in a plane oriented transverse to the direction of stack motion.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the figures and in which.

DESCRIPTION OF THE DISCLOSED EMBODIMENT

With reference now to the drawings, the invention is depicted in the form of a separating device for removing incorrectly gathered, loosely stacked printed sheets from a transport channel 3 which extends between a collating machine, not shown, and an adhesive binding machine, not shown. For purposes of illustration, two stacks of printed sheets, the stacks having differing thickness, have been respectively represented at 1 and 2. Also, for purposes of illustration, it will be presumed that both of stacks 1 and 2 constitute faults and thus both stacks must be diverted from transport channel 3. Stack 1 might, for example, inadvertently include a plurality of folded sheets which should have been part of stack 2.

Figure 1:
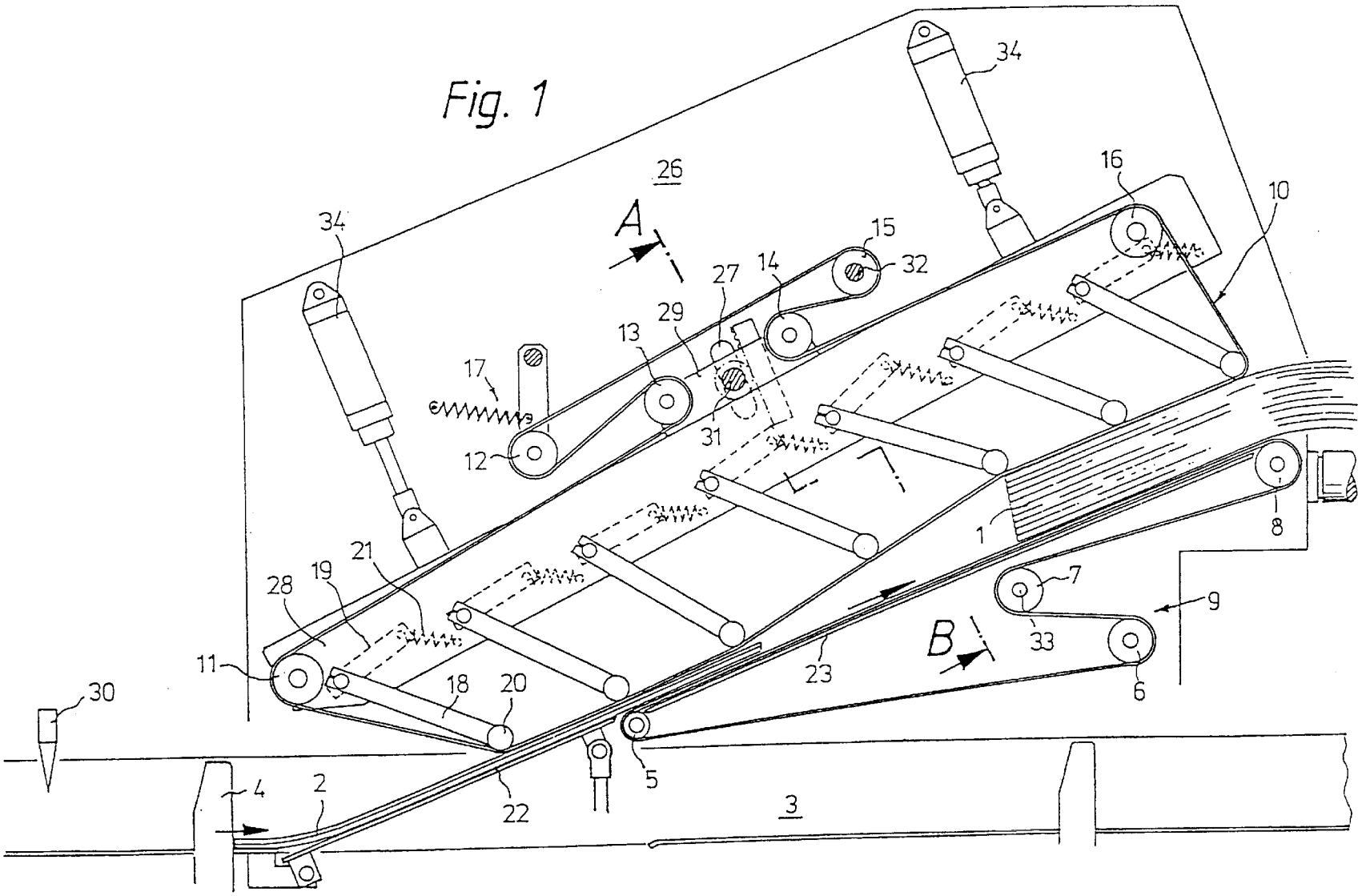
FIG. 1 is a schematic side-elevational view of apparatus in accordance with the invention.
Figure 2:
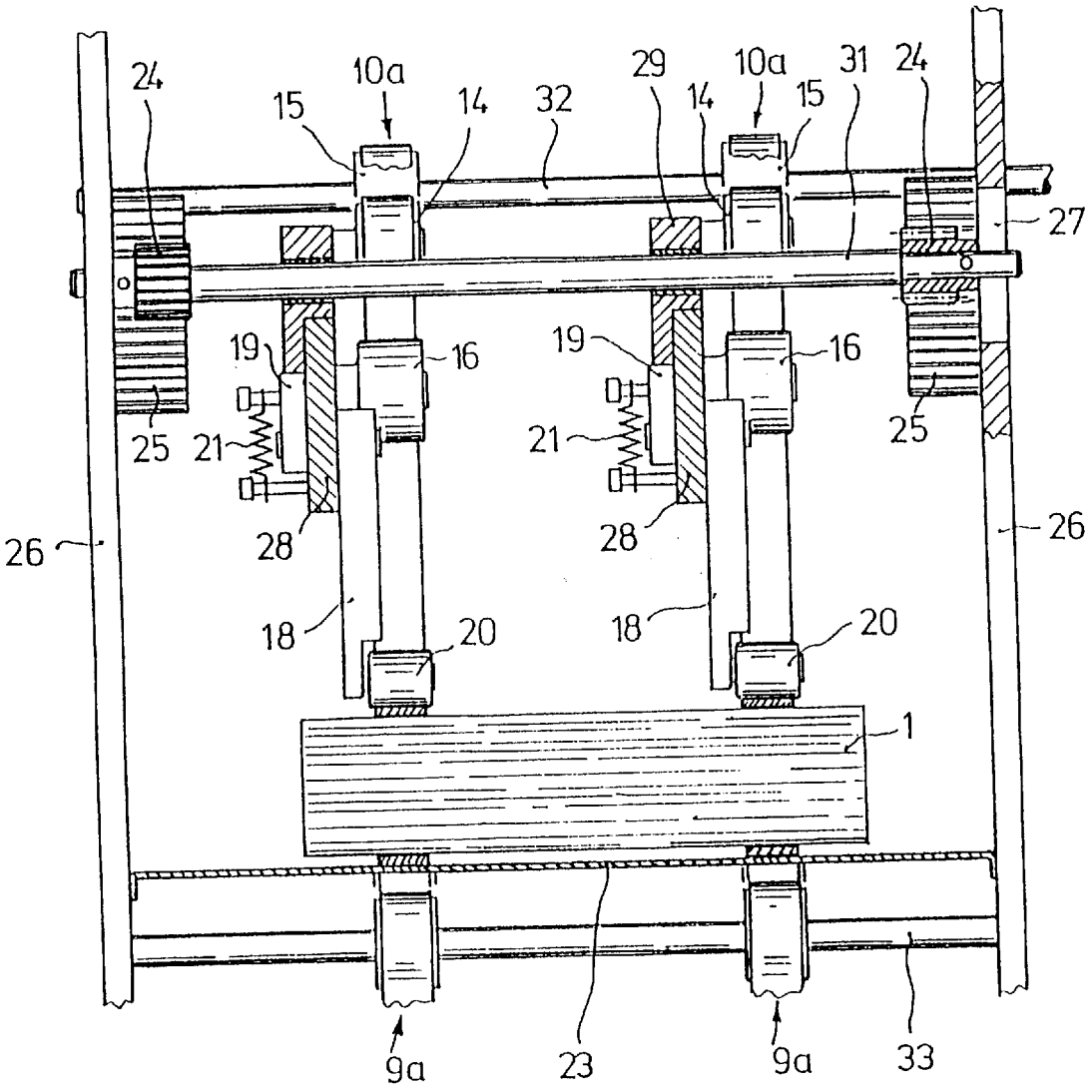
FIG. 2 is an interior elevational view, partly broken away and partly in section of the apparatus of FIG. 1 taken along line A–B thereof.

The separating conveyor device of FIGS. 1 and 2 comprises a system of coacting belt conveyors. Specifically, the system comprises a lower belt conveyor, indicated generally at 9, which includes guide wheels 5–8, an upstream end near wheel 5 and a downstream end near wheel 8. The belt portion of lower conveyor 9, as may be seen from FIG. 2, is defined by a pair of parallel belts or strands 9*a*. The conveyor system also comprises a top belt conveyor, indicated generally at 10, which includes guide wheels 11–16, an upstream end near wheel 11 and a downstream end near wheel 16. Top belt conveyor 10 is driven in synchronism with lower belt conveyor 9 and, like the lower belt conveyor, includes a pair of parallel individual strands or belts 10*a*. The upper belt conveyor also comprises an automatic tensioning device which has been indicated generally at 17.

The operating strands 10*a* of top belt conveyor 10 are additionally each contacted by a plurality of resiliently biased pressure rollers 20. The pressure rollers 20 are mounted on the free ends of pivotal angled levers defined by interconnected lever arms 18 and 19. The resilient biasing of these levers is accomplished by means of tension springs 21. The pressure rollers 20 ensure that stacks of printed sheets being transported by the separating device are clamped between, and thus carried along by, the cooperating belt conveyors 9 and 10. Thus, as clearly shown in FIG. 1, each of the levers 18, 19 is free to individually pivot, counter to the action of a tension spring 21, to compensate for differences in the thickness of the stacks.

The levers 18, 19 are supported from swivel frames 28, and springs 21 are affixed, at first ends thereof, to swivel frames 28. The swivel frames 28, in turn, are situated between a pair of oppositely disposed immobile side frame members 26. The guide wheels 11 and 16 of upper belt conveyor 10 are also supported on the swivel frames 28.

A thrust bearing 29 is affixed to each swivel frame 28. A drive shaft 31 extends between the side frame members 26 and, in so doing, engages thrust bearings 29. For the reason to be explained below, the ends of shaft 31 are received in oblong guide apertures 27 provided in side frame member 26. The guide wheels 13 and 14 of upper belt conveyor 10 are mounted on the thrust bearings 29.

The guide wheels 15 of upper belt conveyor 10 are mounted on a further shaft 32 which extends between the side frame members 26. Finally, the guide wheels 12 of upper belt conveyor 10 are supported by the tensioning devices 17 which, in turn, are mounted on the side frame members 26.

The guide wheels 5–8 of lower belt conveyor 9 are mounted on shafts, such as the shaft 33 shown in FIG. 2, which extend between the side frame members 26.

In order to develop the requisite clamping force for the stacks 1, 2 of printed sheets, the operating strands 9*a* of lower belt conveyor 9 are led across the upper surface of a fixed position support plate 23 which extends along, and thus defines, the movement path between guide wheels 5 and 8.

The upper belt conveyor 10 has upstream and downstream ends or "line portions" which are separated by a distance greater than the cyclical interval between successively received stacks 1, 2. Restated, the line or region of engagement of a stack of printed sheets by belt conveyor 10 and the line of release of a transported stack from belt conveyor 10 are separated by a distance which enables the separating device to simultaneously convey, i.e., impart movement to, two printed sheet stacks taking into account the transport speed and the spacing between the stacks discharged from the upstream collating machine.

The position of the upper belt conveyor 10, in the region of its front and rear line portions, is adjustable so as to vary the distance between the upper and lower belt conveyors. This adjustment permits a pair of printed sheet stacks which are fed successively at the cyclical interval, and which differ substantially in thickness from one another, to be reliably separated at the same time from the transport channel 3. In the disclosed embodiment, the variation in the spacing between the upper and lower belt conveyors is accomplished by imposing tilting moments on the swivel frames 28. These tilting forces are produced by the action of working cylinders 34 which, in effect, act on the opposite ends of the swivel frames 28 and cause these frames to rotate about the axis of the shaft 31 which passes through the thrust bearings 29 affixed to frames 28.

In the operation of the disclosed embodiment, printed sheet stacks are advanced along the transport channel 3 by means of chain driven transporters 4 which extend upwardly through slots in the bottom of the transport channel. A pivotal deflector plate 22 is located in transport channel 3 immediately upstream of lower conveyor 9. When actuated to the position shown in FIG. 1, deflector plate 22 will cause a stack of printed sheets moving along the channel 3 to be driven by transporters 4 to the position where the leading edge region of the stack is disposed between the upper and lower belt conveyors 9 and 10. The belt conveyors of the separating device will then take over the downstream movement of the deflected stack. In the disclosed apparatus, a decision to "reject" a stack of printed sheets results from the monitoring action of a thickness-measuring device 30, located upstream of the deflector 22. Detection device 30 is preferably a photoelectric sensor installed in the transport channel 3 in the vicinity of distributing guide 22. The preferred photoelectric sensor is available from Baumer Electric Ltd. of Southington, Conn., USA under the model number FHDK 10 P1101. When the thickness-measuring device 30 senses a deviation in stack thickness which exceeds a preset tolerance range, a control signal will be generated which will actuate the deflector plate 22 and also actuate the appropriate working cylinders 34 to thereby produce the requisite tilting motion of the swivel frames 28 to adjust the distance between the upper and lower belt conveyors either in the front or rear line portions thereof. In the preferred embodiment 40 millimeters is the breakpoint value which will trigger readjustment of cylinders 34 and the maximum thickness which can be accommodated is 80 millimeters. Thus, detection of a stack with a thickness of less than 40 millimeters will cause the upstream portion of top conveyor 10 to remain at, or to move to, a downward position. Further, detection of a stack with a thickness of between 40 and 80 millimeters will cause the upstream portion of top conveyor 10 to remain at, or move to, an upward position. Preferably, movement of the downstream portion of top conveyor 10 follows that of the upstream portion in delayed fashion. The preferred delay is equal to the cyclical interval at which the stacks move along the transport path.

The tilting motion of the swivel frames 28 is accomplished in such a manner as to ensure that parallelism of the strands 10*a* of the upper belt conveyor 10 is maintained. This is achieved by a mechanical connection, in the form of gear mechanisms, interposed between each end of shaft 31 and the side frame members 26. Thus, pinion gears 24 are mounted on the shaft 31 and engage gear racks 25 which are affixed to the side frame members 26. As the pinions 24 move along the racks 25 in response to the pulling or pushing of an end of the swivel frames 28, the ends of shafts 31 will simultaneously slide in the linear apertures 27 in side frame members 26.

In a modified construction, both belt conveyors 9, 10 may be disposed on a tiltable swivel frame for varying the distance of the front or rear line portion of the system of belt conveyors.

While a preferred embodiment has been shown and described, various modifications and substitutions may be made thereto without deviating from the spirit and scope of the invention. Accordingly, it is to be understood that the present invention has been described by way of illustration and not limitation.

What is claimed is:

1. Apparatus for conveying product stacks in a downstream direction, the product stacks being received by said apparatus at defined cyclical intervals and having differing thicknesses that may deviate from a predetermined tolerance range, said apparatus comprising:

a thickness measuring device for measuring the thickness of the product stacks to thereby produce thickness value signals;

a first belt conveyor;

a second belt conveyor, said first and second belt conveyors having respective opposing upstream and downstream ends and cooperating to clamp multiple product stacks of varying thickness simultaneously therebetween, said first and second belt conveyors moving at the same speed in the downstream direction whereby the clamped stacks of products will be conveyed from said upstream ends to said downstream ends of said conveyors without stack misalignment; and means for varying the spacing between said belts of said first and second conveyors at at least one of said respective opposing upstream and downstream ends in response to said thickness value signals.

2. The apparatus of claim 1 wherein said means for varying comprises means for adjusting the position of only one of said first and second belt conveyors.

3. The apparatus of claim 1 wherein said second belt conveyor further comprises a plurality of resiliently-biased pressure rollers which urge said second conveyor toward said first conveyor and wherein said means for varying is only capable of adjusting the position of at least one of said upstream and downstream ends of second belt conveyor.

4. The apparatus of claim 2 wherein said second belt conveyor further comprises a plurality of resiliently-biased pressure rollers which urge said second conveyor toward said first conveyor and wherein said means for varying is only capable of adjusting the position of at least one of said upstream and downstream ends of second belt conveyor.

5. The apparatus of claim 1 wherein each of said first and second belt conveyors includes first and second parallel strands which contact the product stacks and move at the same speed as one another.

6. The apparatus of claim 3 wherein each of said first and second belt conveyors includes first and second parallel strands which contact the product stacks and move at the same speed as one another.

7. The apparatus of claim 1 wherein said means for varying includes a swivel frame upon which said second belt conveyor is situated, an axle about which said swivel frame may be tilted, and at least one actuatable working-cylinder operatively associated with said swivel frame to tilt said swivel frame upon actuation of said working-cylinder.

8. The apparatus of claim 3 wherein said means for varying includes a swivel frame upon which said second belt conveyor is situated, an axle about which said swivel frame may be tilted, and at least one actuatable working-cylinder operatively associated with said swivel frame to tilt said swivel frame upon actuation of said working-cylinder.

9. The apparatus of claim 5 wherein said means for varying includes a swivel frame upon which said second belt conveyor is situated, an axle about which said swivel frame may be tilted, and at least one actuatable working-cylinder operatively associated with said swivel frame to tilt said swivel frame upon actuation of said working-cylinder.

10. The apparatus of claim 7 wherein said means for varying further comprises means for supporting said axle such that said swivel frame is capable of both tilting and linear-yielding motion simultaneously.

11. The apparatus of claim 8 wherein said means for varying further comprises means for supporting said axle such that said swivel frame is capable of both tilting and linear-yielding motion simultaneously.

12. The apparatus of claim 9 wherein said means for varying further comprises means for supporting said axle such that said swivel frame is capable of both tilting and linear-yielding motion simultaneously.

13. The apparatus of claim 1 further comprising a pivotable deflector plate disposed immediately upstream of said first and second belt conveyors, said deflector plate selectively guiding the product stacks between said first and second conveyors in response to said thickness values.

14. The apparatus of claim 3 further comprising a pivotable deflector plate disposed immediately upstream of said first and second belt conveyors, said deflector plate selectively guiding the product stacks between said first and second conveyors in response to said thickness values.

15. The apparatus of claim 5 further comprising a pivotable deflector plate disposed immediately upstream of said first and second belt conveyors, said deflector plate selectively guiding the product stacks between said first and second conveyors in response to said thickness values.

16. The apparatus of claim 7 further comprising a pivotable deflector plate disposed immediately upstream of said first and second belt conveyors, said deflector plate selectively guiding the product stacks between said first and second conveyors in response to said thickness values.

17. The apparatus of claim 12 wherein said means for varying further comprises means for maintaining said parallelism between said first and second strands of said second belt conveyor during movement of said swivel frame.

* * * * *